US005911572A

United States Patent [19]

Williams

[11] Patent Number: 5,911,572

[45] Date of Patent: Jun. 15, 1999

[54] SPARK IGNITION ELECTRODE ASSEMBLY FOR GAS STOVE TOP BURNER

[75] Inventor: Darryl Williams, Plainfield, Ill.

[73] Assignee: Harper-Wyman Company, Aurora, Ill.

[21] Appl. No.: 09/118,595

[22] Filed: Jul. 17, 1998

[51] Int. Cl.[6] ..... F24C 3/10

[52] U.S. Cl. ..... 431/132; 431/266; 126/39 E; 313/143

[58] Field of Search ..... 431/132, 191, 431/192, 255, 263, 264, 265, 266; 126/39 E; 313/128, 132, 143, 609, 610, 611, 612

[56] References Cited

U.S. PATENT DOCUMENTS

| | | | |
|---|---|---|---|
| 1,343,348 | 6/1920 | Camporini | 313/128 |
| 4,288,210 | 9/1981 | Leonard et al. | 431/263 |
| 4,307,316 | 12/1981 | McKechnie | 313/143 |
| 4,381,758 | 5/1983 | Svekis et al. | 431/263 |
| 4,626,196 | 12/1986 | Stohrer, Jr. | 431/264 |
| 4,810,188 | 3/1989 | Kwiatek | 431/266 |
| 4,846,671 | 7/1989 | Kwiatek | 431/266 |
| 5,364,264 | 11/1994 | Kwiatek | 431/266 |
| 5,397,234 | 3/1995 | Kwiatek | 431/264 |

*Primary Examiner*—Ira S. Lazarus
*Assistant Examiner*—Sara Raab
*Attorney, Agent, or Firm*—Mason, Kolehmainen, Rathburn and Wyss; Joan Pennington

[57] ABSTRACT

A spark ignition electrode assembly includes an electrode wire and an electrically insulative support member receiving and positioning the electrode wire proximate to the gas burner. The electrically insulative support member includes a threaded outer wall portion for receipt within a corresponding internally threaded aperture in the cooktop wall. The threaded outer wall portion is threadingly inserted in the corresponding cooktop aperture for positioning the spark ignition electrode assembly with the gas burner.

9 Claims, 1 Drawing Sheet

SPARK IGNITION ELECTRODE ASSEMBLY FOR GAS STOVE TOP BURNER

FIELD OF THE INVENTION

The present invention relates generally to spark ignition for gas burners, and more particularly to an improved spark ignition electrode assembly for a gas burner for a gas stove top.

DESCRIPTION OF THE PRIOR ART

Spark ignition typically is used with gas burners. Spark ignition avoids the energy consumption and heat caused by a standing igniter pilot flame that was often used in the past to ignite gas burners, such as gas range top and oven burners. Examples of spark ignited gas burners are provided by U.S. Pat. No. 4,626,196 issued Dec. 2, 1986, U.S. Pat. No. 4,810,188 issued Mar. 7, 1989 and U.S. Pat. No. 4,846,671 issued Jul. 11, 1989, assigned to the assignee of the present invention.

U.S. Pat. No. 5,364,264 issued Nov. 15, 1994, and U.S. Pat. No. 5,397,234 issued Mar. 14, 1995, and assigned to the assignee of the present invention, disclose spark ignition arrangements that eliminates the possibility of electrical shock to the user. The spark electrode assembly includes an electrically conductive electrode contained within an electrically insulative support member. The electrically conductive electrode is positioned by the electrically insulative support member proximate to a predetermined portion of the gas burner. The electrically insulative support member formed of ceramic material has a predetermined wall thickness proximate to the gas burner portion providing a cover for the electrically conductive electrode while allowing a high voltage potential applied to the electrode to discharge through the ceramic material.

While these spark ignited gas burner arrangements provide improvements over many existing spark ignition arrangements, it is desirable to provide an improved spark ignition electrode assembly that provides effective and reliable operation; that is easily mounted within a cooktop wall of the gas stove top; and that can be easily manufactured.

SUMMARY OF THE INVENTION

Among the principal objects of the present invention are to provide a spark ignition electrode assembly for a gas burner for a gas stove top; to provide a new and improved spark ignition electrode assembly that provides effective and reliable operation; and to provide a spark ignition electrode assembly overcoming some of the disadvantages of known spark ignition arrangements.

In brief, the objects and advantages of the present invention are achieved by a spark ignition electrode assembly. The spark ignition electrode assembly includes an electrode wire and an electrically insulative support member receiving and positioning the electrode wire proximate to the gas burner. The electrically insulative support member includes a threaded outer wall portion for receipt within a corresponding internally threaded aperture in the cooktop wall. The threaded outer wall portion is threadingly inserted in the corresponding cooktop aperture for positioning the spark ignition electrode assembly with the gas burner.

BRIEF DESCRIPTION OF THE DRAWINGS

The present invention together with the above and other objects and advantages may best be understood from the following detailed description of the preferred embodiments of the invention illustrated in the drawings, wherein.

DETAILED DESCRIPTION OF THE PREFERRED EMBODIMENTS

Figure 1:
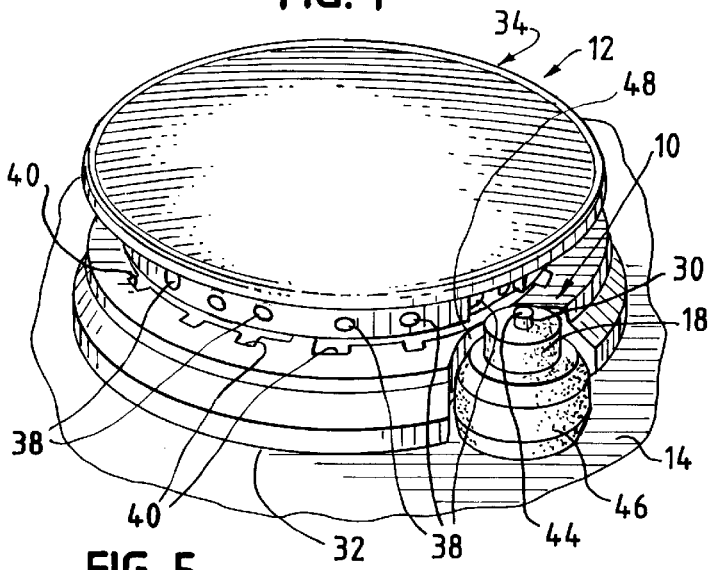
FIG. 1 is a perspective view of a spark ignition electrode assembly together with a gas burner assembly constructed in accordance with the principles of the present invention.
Figure 2:
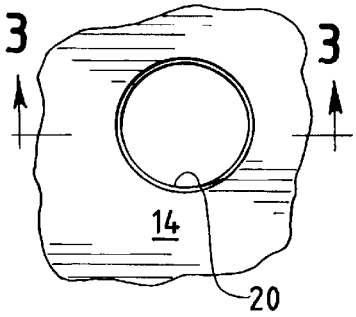
FIG. 2 is a fragmentary bottom view of the stove cooktop wall of the spark ignition electrode assembly of FIG. 1.
Figure 3:
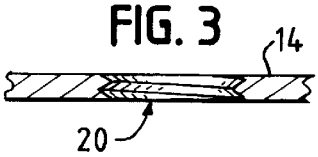
FIG. 3 is a sectional view of the stove cooktop wall taken along line 3—3 of FIG. 2.
Figure 5:
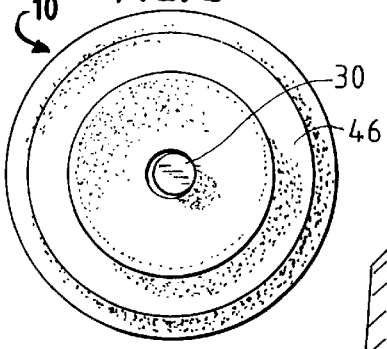
FIG. 5 is a top view of the spark ignition electrode assembly of FIG. 1.

Referring now to the drawings, in FIGS. 1–6, there is illustrated a spark ignition electrode assembly designated as a whole by the reference character 10 together with a gas burner assembly 12 and arranged in accordance with principles of the present invention. In FIG. 1, a perspective view of a spark ignition electrode assembly 10 is shown assembled with a gas stove cooktop 14. A plurality of mounting threads 16 formed on an electrode support member 18 of the spark ignition electrode assembly 10 are threadingly received in a tapped aperture 20 of the gas stove cooktop 14 to secure the spark ignition electrode assembly 10 in position.

The spark ignition assembly 10 includes the electrode support member 18 and a spark ignition electrode wire 30. An ignition circuit (not shown) selectively provides a high voltage potential to the electrode wire 30. The gas burner assembly 12 includes a gas burner base 32 and cap 34 that are provided an electrical ground potential so that applying high voltage potential to the electrode wire 30 causes ignition sparks to be produced. The electrode wire 30 is an integral member formed of electrically conductive material, such as #310 stainless steel. The electrode support member 18 is formed of an electrically insulative material, preferably a ceramic material, such as an unglazed L5 steatite material.

In accordance with features of the invention, the mounting threads 16 integrally formed with the ceramic electrode support member 18 provide advantages over discrete fasteners arrangements that have been used in the past. The complexity and expense of providing and handling discrete fasteners or clips is avoided. The mounting of the spark ignition assembly 10 to the stove cooktop 14 is accomplished easily and quickly. It is not necessary to reach beneath stove cooktop 14 to install clips or other fasteners.

The mounting threads 16 are included within the electrode support member 18 without requiring additional machine processes in the manufacture of the electrode support member 18. The spark ignition electrode assembly 10 is rugged and not easily breakable or damaged both during assembly and use.

In FIG. 1, the gas burner assembly 12 is shown with the spark ignition electrode assembly 10 of the preferred embodiment. The gas burner cap 34 is supported by gas burner base 32 which together define a burner fuel chamber. The gas burner cap 34 includes a plurality of main burner ports 38 where a gas and primary air mixture exits and burns in the presence of secondary air. The gas burner base 32 also includes a plurality of secondary burner ports 40 where the mixture exits and burns in the presence of secondary air. The gas burner base 32 and the gas burner cap 34 are formed, for example, by casting technique of an electrically conductive material, such as aluminum alloy. The secondary burner ports 40 provide a small secondary flame particularly effective for maintaining combustion at low fuel rates. The small secondary flame effectively maintains stable combustion, avoiding externally caused disruptions otherwise resulting, such as, from drafts or an oven door slam. The spark ignition assembly 10 is operatively positioned outside the burner fuel chamber near ones of the main burner ports 38 and secondary burner ports 40. It should be understood that the spark ignition assembly 10 of the invention is not limited for use with the burner assembly 12 as shown in FIG. 1. The spark ignition assembly 10 can be used with various burner assemblies of different configurations.

Figure 6:
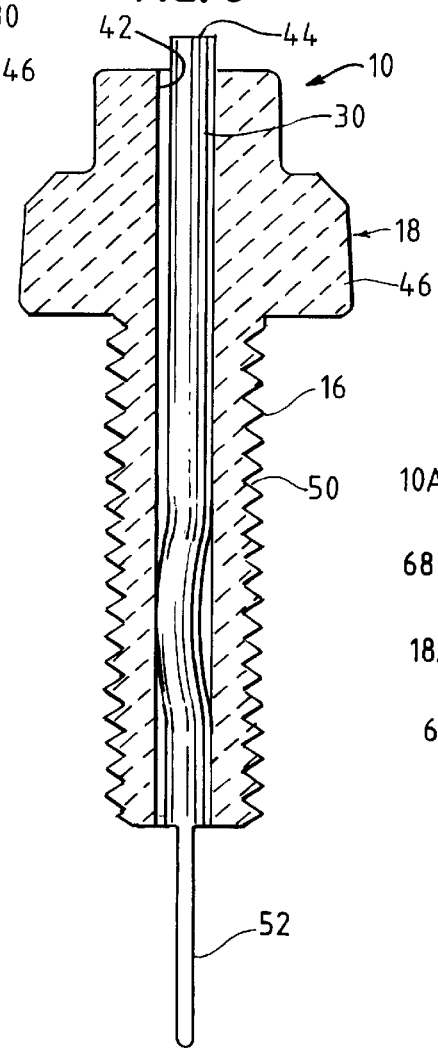
FIG. 6 is a fragmentary cross-sectional view taken along the line 6—6 of FIG. 4.
Figure 4:
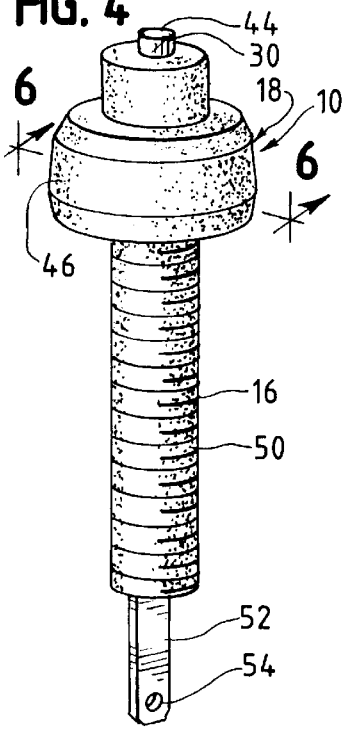
FIG. 4 is a perspective view of the spark ignition electrode assembly of FIG. 1 constructed in accordance with the principles of the present invention.

Referring to FIGS. 4 and 6, an opening 42 within the ceramic electrode support member 18 receiving the electrode wire 30 is sized for an interference fit with the electrode wire 30. As shown in FIGS. 1, 4, and 6, an upper end portion 44 of the electrode wire 30 is disposed proximate to main burner ports 38 and secondary burner ports 40. An upper portion 46 of the insulative support member 18 seated on and supported by the stove cooktop 14 is positioned within a curved recessed portion 48 provided in the gas burner base 32 positioning the spark ignition assembly 10 relative to the burner ports 38 and 40. A lower, elongated body portion 50 of support member 18 carrying the mounting threads 16 encloses the electrode wire 30 below the gas stove cooktop wall 14. A lower, downwardly depending portion 52 of the electrode wire 30 extends below the lower body portion 50 includes an aperture 54 for connecting the spark electrode wire 30 to the high voltage potential.

Figure 7:
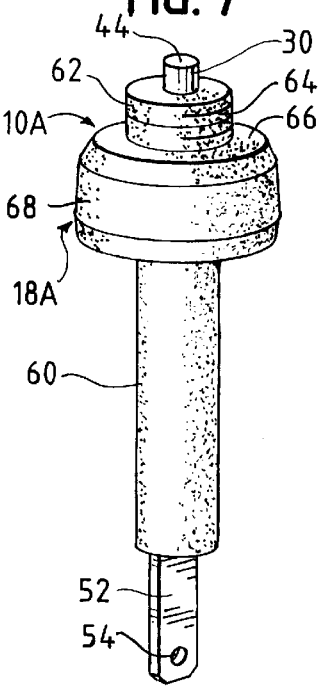
FIG. 7 is a perspective view similar to FIG. 4 illustrating an alternative spark ignition electrode assembly and mounting arrangement for the spark ignition electrode assembly in accordance with the principles of the present invention.

Referring now to FIG. 7, a perspective view similar to FIG. 4 illustrates an alternative spark ignition electrode assembly generally designated by the reference character 10A and arranged in accordance with the principles of the present invention. In FIG. 7, the alternative spark ignition electrode assembly 10A is shown in perspective view. In FIG. 7, the same reference characters as used in FIGS. 1–6 are used for similar or unchanged components. Spark ignition electrode assembly 10A has a different mounting arrangement as compared to the spark ignition electrode assembly 10 of FIGS. 1–6.

Referring to FIGS. 6–7, spark ignition electrode assembly 10A includes an unchanged spark ignition electrode wire 30 and an electrically insulative support member 18A. Electrically insulative support member 18A includes a cylindrical lower body portion 60 with a threaded upper body portion 62 carrying mounting threads 64 that are threadingly received, upwardly through the corresponding tapped opening 20 in the stove cooktop 14. A top surface 66 of a flanged portion 68 of the support member 18A is seated beneath the stove cooktop 14.

Identical materials and an identical method of manufacture are used for the alternative spark ignition electrode assembly 10A as used for the spark ignition electrode assembly 10 of FIGS. 1–6.

While the present invention has been described with reference to the details of the embodiments of the invention shown in the drawing, these details are not intended to limit the scope of the invention as claimed in the appended claims.

What is claimed is:

1. A spark ignition electrode assembly for a gas burner comprising:

an electrode wire;

an electrically insulative support member receiving and positioning said electrode wire proximate to the gas burner;

said electrically insulative support member including a threaded outer wall portion threadingly received within a corresponding internally threaded cooktop aperture for mounting the spark ignition electrode assembly; and said electrically insulative support member being formed of a ceramic material and wherein said threaded outer wall portion being provided on a lower downwardly depending portion of said electrically insulative support member.

2. A spark ignition electrode assembly for a gas burner as recited in claim 1 wherein said threaded outer wall portion is downwardly threadingly inserted into said corresponding cooktop aperture for mounting the spark ignition electrode assembly with the cooktop.

3. A spark ignition electrode assembly for a gas burner comprising:

an electrode wire;

an electrically insulative support member receiving and positioning said electrode wire proximate to the gas burner;

said electrically insulative support member including a threaded outer wall portion threadingly received within a corresponding internally threaded cooktop aperture for mounting the spark ignition electrode assembly; and said electrically insulative support member being formed of a ceramic material and said threaded outer wall portion being provided on an upper portion of said electrically insulative support member.

4. A spark ignition electrode assembly for a gas burner as recited in claim 3 wherein said threaded outer wall portion is upwardly threadingly inserted into said corresponding cooktop aperture for mounting the spark ignition electrode assembly with the cooktop.

5. A spark ignition electrode assembly for a gas burner as recited in claim 3 wherein said electrode wire is an integral steel member.

6. A method for mounting a spark ignition electrode assembly for a gas burner comprising the steps of:

forming ceramic material to define an electrically insulative support member having an electrode wire receiving opening receiving and positioning an electrode wire proximate to the gas burner and having a threaded outer wall portion;

providing a corresponding cooktop aperture for threadingly receiving said threaded outer wall portion; and threadingly inserting said threaded outer wall portion into said corresponding cooktop aperture for mounting the spark ignition electrode assembly with the cooktop.

7. A method of making a spark ignition electrode assembly for a gas burner as recited in claim 6 wherein said step of forming ceramic material to define said electrically insulative support member includes forming said threaded outer wall portion on a lower body portion and said threadingly inserting step includes downwardly threadingly inserting said threaded outer wall portion into said corresponding cooktop aperture for mounting the spark ignition electrode assembly with the cooktop.

8. A method of making a spark ignition electrode assembly for a gas burner as recited in claim 6 wherein said step of forming ceramic material to define said electrically insulative support member includes forming said threaded outer wall portion on an upper body portion and said threadingly inserting step includes upwardly threadingly inserting said threaded outer wall portion into said corresponding cooktop aperture for mounting the spark ignition electrode assembly with the cooktop.

9. A method of making a spark ignition electrode assembly for a gas burner as recited in claim 6 providing an integral stainless steel member forming said electrode wire.

* * * * *